United States Patent [19]

Canaud et al.

[11] Patent Number: 4,875,833

[45] Date of Patent: Oct. 24, 1989

[54] PUMPING OF HIGH VISCOSITY MATERIALS

[75] Inventors: Michel Canaud, Paris; Philippe Dewitte, Thourotte, both of France

[73] Assignee: Saint-Gobain Vitrage, Courbevoie, France

[21] Appl. No.: 19,378

[22] Filed: Feb. 20, 1987

[30] Foreign Application Priority Data

| | | | |
|---|---|---|---|
| Feb. 20, 1986 | [FR] | France | 86 02344 |
| Jan. 22, 1987 | [FR] | France | 87 00709 |
| Jan. 22, 1987 | [FR] | France | 87 00710 |

[51] Int. Cl.[4] ..... F04B 5/00; F04B 21/00

[52] U.S. Cl. ..... 417/259; 417/489

[58] Field of Search ..... 417/489, 259, 262, 264

[56] References Cited

U.S. PATENT DOCUMENTS

| | | | |
|---|---|---|---|
| 2,136,636 | 11/1938 | Rotter | 417/264 |
| 2,636,441 | 4/1953 | Woelfer | 417/264 |
| 2,787,225 | 4/1957 | Rotter | 417/489 |
| 2,925,941 | 2/1960 | Bloxom | 417/489 |
| 3,160,105 | 12/1964 | Sherman et al. | 417/262 |
| 3,312,178 | 4/1967 | Rotter et al. | 417/489 |
| 3,995,966 | 12/1976 | Blancha | 417/559 |
| 4,014,629 | 3/1977 | Elsworth | 417/259 |
| 4,591,316 | 5/1986 | Vadasz Fekete | 417/514 |
| 4,679,989 | 7/1987 | Harriman | 417/489 |

FOREIGN PATENT DOCUMENTS

| | | |
|---|---|---|
| 2567448 | 1/1986 | France . |
| 2570322 | 3/1986 | France . |

*Primary Examiner*—William L. Freeh

*Attorney, Agent, or Firm*—Oblon, Spivak, McClelland, Maier & Neustadt

[57] ABSTRACT

A vane pump in which the ports for passage of highly viscous material pumped are widely dimensioned and the clearances, in particular around the rod which carries the vane, are great. The invention applies to the pumping of materials of the type having a base of butyl rubber and/or polyisobutylene, and in general of materials exhibiting a viscosity greater than 35,000 poises.

23 Claims, 4 Drawing Sheets

PUMPING OF HIGH VISCOSITY MATERIALS

BACKGROUND OF THE INVENTION

1. Field of the Invention

The invention relates to the pumping of highly viscous materials such as plastics of the type having a base of butyl rubber and/or polyisobutylene and exhibiting a viscosity greater than 35,000 poises (3500 Pa·S). Being suitable for the pumping of highly viscous materials, with a viscosity greater than 35,000 poises, the invention is also suitable for the pumping of materials exhibiting a lower viscosity.

2. Discussion of the Related Art

Reciprocating vane pumps driven by a pneumatic means, able to pump relatively slightly viscous materials, and permitting a maximum viscosity on the order of 35,000 poses are known. Thus, polysulfide which has a viscosity of 35,000 posies represents, from the viewpoint of viscosity, the limit of what the known reciprocating vane pumps can pump.

These pumps are driven pneumatically; they are provided with narrow passages practically without clearance, in particular at the position of the ring-shaped check valves mounted around the rod which carries the vane, and they have narrow ports of 5 $mm^2$ or less for the passage of the material to be pumped.

These pumps prove to have absolutely zero effectiveness for pumping materials of the type having a base of rubber butyl and/or polyisobutylene with a molecular weight on the order of 8,000 to 15,000 (according to STANDINGER), these materials having a viscosity which, expressed in Mooney degrees, is on the order of, or greater than, 115° at the end of eight minutes and at a temperature of 40° C. (measurement made with a Mooney consistometer according to the recommendation ASTM D 1646-74).

Actually, these materials having a base of rubber and/or polyisobutylene, and other materials of the same consistency, are too thick for the vanes of these pumps to succeed in penetrating them. Increasing the power of the motor of the pumps to press the vane with more force has been tried, but the rod which carries the vane then deforms laterally and is locked in the narrow passages where it slides, in particular in the check valves which surround it like a ring. If the power is further raised, the rod wears and forms shavings by rubbing against the walls of said narrow passages and in particular of the ring valves.

Reinforcing the rod by increasing its section has been tried, but it was also necessary to increase the size of the other elements of the pump and consequently at the same time the power of the motor. Huge pumps thus resulted and the power thus used were such that the tanks into which it was desired to pump the material were no longer strong enough to absorb the pressure to which they were subjected, with the result that they burst.

In the face of the complete ineffectiveness of these reciprocating vane pumps to pump high-viscosity materials, a device described in French Patent Applications published under the Nos. 2 567 448, 2 570 322, 2 570 443, 2 570 324, 2 570 323, was resorted to for feeding of a thick plastic having a butyl rubber and/or polyisobutylene base of molecular weight on the order of 8,000 to 15,000, together with an extrusion head intended to furnish a bead of said plastic able to be used as a seal and interlayer between two consecutive sheets of glass in multiple glazings.

This unit uses a concial plate equipped with heating appendages and provided with a port at the conically shaped vertex through which the material is extracted. This plate is pressed with force against the plastic contained in a tank. The heat and the particular shape of the plate cause material to be extracted through the port for feeding an internal gear pump. This gear pump causes the material to advance in rigid pipes connected, via rotary seals, to a variable volume storage bin placed immediately upstream from the extrusion head. At the position of the gear pump, the flow is still slight and the material is still thick, with the result that to obtain a sufficient flow to prevent damaging the gears of the pump and the drive system, said pump is fed simultaneously on both faces of the gears, the teeth of the gears are trapezoidal and the drive of said pump is hydraulic.

With these devices, plastic of the type having a butyl rubber and/or polyisobutylene base of molecular weight of 8,000 to 15,000, was extracted from the tank where it is stored at a sufficient flow rate and with a sufficient consistency to feed an extrusion head and continuously produce multiple glazings of large dimensions (about 10 m of maximum perimeter), with an interlayer bead of said plastic separating two consecutive sheets of glass, and forming a seal between said two sheets of glass, by a height that can go to 12 mm, the sheets of glass passing under the extrusion head at speeds on the order of 20 m/min, i.e., with a flow on the order of 1 kg per minute. However, this unit for preparation and extraction of the plastic nevertheless poses problems.

Actually, the material exits at a high temperature on the order of about 130° C. This temperature is due to the heating occuring at the conical plate, but it is also due in large part to the shearing that the material undergoes in the gear pump. This high temperature at which the plastic is supplied can be harmful. Actually, if this material is extruded at too high a temperature, the bead obtained is too soft and has a tendency to creep and to collapse under its own weight. It is then necessary to provide means to support it as soon as it is placed on a sheet of glass, in particular if it has a great height. Such means are, for example, described in French Patent Application No. 84-14185.

Furthermore, for other applications, in particular in the field of automobiles, a need is felt for pumps able to pump thick plastics, optionally without it being necessary to heat them too highly, and so far, this need has not been met.

SUMMARY OF THE INVENTION

This invention has as its object the avoidance of the drawbacks of the above pumping units, in the production of multiple glazings with seals and interlayers of organic materials.

A further object of the invention is to meet the unmet needs in the field of automobiles.

For this, the invention proposes a reciprocating vane pump able to pump thick materials with a viscosity greater than 35,000 poises, having a piston, sliding on the inside of the pump body and connected to a rod which extends along the length of said pump body and having a distal end at the intake of the pump to which is connected a vane. Partitions divide the pump into several stages and have ports to allow the passage of the piston and the material pumped from the intake of the pump to its outlet. Check valves are associated with at least some of these ports, and are of the ball and/or ring-shaped type surrounding the rod connected to the piston. The check valves and the ports for passage of the material are of a sufficiently large section to permit free passage of the material.

According to a secondary feature of the invention, each check valve is assisted by a push spring. According to another secondary feature, all the movable elements of the pump have smooth surfaces, i.e., lack attached seals.

Advantageously, according to a first embodiment, the vane placed at the distal end of the rod which passes through the pump body is a simple plate.

Advantageously, according to a second embodiment, this vane has at least in two superposed parts: a disk pierced with passage ports for the material to be pumped and fastened to the distal end of the rod and a plate extending parallel to the disk and mounted to slide on the rod so as to be able to be pressed against the disk or, on the other hand, to move away from it.

Advantageously, according to a third embodiment, the vane placed at the distal end of the rod which passes through the pump body consists essentially of a volume whose shape is hydrodynamic in all directions. In a preferred version of this third embodiment, this form is spherical or approximately spherical.

Advantageously, this pump is fixed to a concave conically shaped heating plate provided with an opening at the conical apex into which the vane is inserted. This conical heating plate is mounted on a tank containing the material to be pumped with its concave face being turned toward the material and pressed thereagainst.

Such a pump and such a unit made up of the pump and a conical heating plate finds an application in the pumping of thick materials and in particular in the pumping of materials having a butyl rubber and polyisobutylene base of molecular weight on the order of 8,000 to 15,000, intended for the production of a sized bead used as a seal and interlayer in multiple glazings, and in general of materials which exhibit a high viscosity greater than 35,000 poises and which can go up to a Mooney viscosity on the order of, or greater than, 115° at the end of 8 minutes at 40° C., a measurement made using a Mooney consistometer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
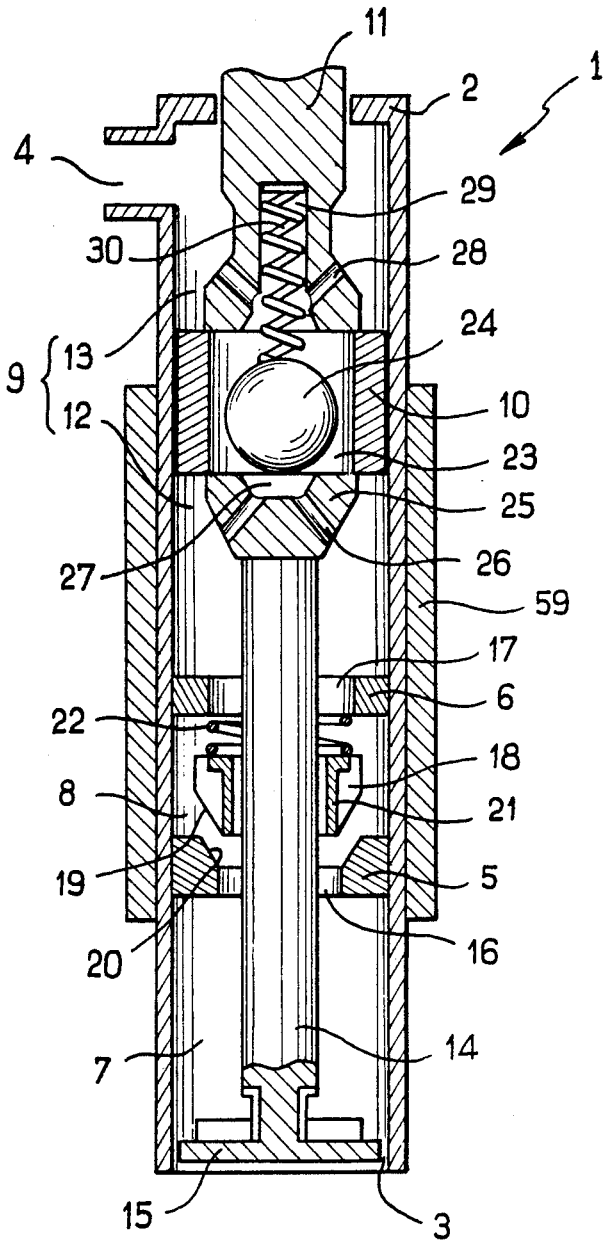
FIG. 1 is a view in section of the pump according to the invention.

FIG. 1 shows a reciprocating vane pump 1 according to the invention. It comprises a cylindrical pump body 2 having an intake 3 for the material to be pumped at one end of the pump body and an outlet 4 for the pumped material at the other end. The interior of this pump body 2 is separated into three superposed stages by partitions 5 and 6 which delimit a boosting or intake stage 7, an intermediate or buffer stage 8, and an evacuation stage 9 which is equipped with outlet 4 close to the end of the pump body.

On the inside of evacuation stage 9 slides a piston 10 which is moved in reciprocating motion by a hydraulic motor (not shown in this figure) connected to said piston 10 by a shaft 11. This piston separates evacuation stage 9 into two chambers whose volume varies when said piston moves; a lower chamber 12 and an upper chamber 13.

At its face opposite the one which connects it to shaft 11, piston 10 is fixed to a rod 14 which extends along the axis of the pump body and passes through said pump body up to the vicinity of inlet 3. Fastened at the free end of rod 14, and extending perpendicular to said rod, is a vane 15 of section slightly less than that of the inside of pump body 2.

Partitions 5 and 6 are each equipped with a port through which rod 14 passes and also with passages such as 16 and 17, respectively, for the routing of the material to be pumped from one stage to another.

Passages 16 of partition 5 can be obstructed by a ring-shaped check valve 18 surrounding rod 14 and placed in buffer stage 8. This ring-shaped valve has oblique outer walls 19 able to cooperate with oblique walls 20 of partition 5 which form a seat for valve 18.

The ring 21 of valve 18 serves as a guide for rod 14. To facilitate the sliding, the inside of the ring is provided with a bearing surface, particularly of bronze. A spring 22 is inserted between valve 18 and partition 6 to help said valve 18 to close.

Piston 10 is hollow and contains a cavity 23 through which the pumped material can advance. On the inside of this cavity 23 is housed a ball-shaped check valve 24.

Rod 14 is fixed to piston 10 by a head 25 pierced with ducts such as 26 for the passage of the pumped material, these ducts 26 ending in a common flare 27 communicating with cavity 23 and shaped so as to serve as a seat for ball-shaped check valve 24.

The head of shaft 11, on the side of piston 10, is pierced with ducts 28 which put cavity 23 in communication with upper chamber 13 of evacuation stage 9.

The end of shaft 11 is pierced with an axially extending recess 29 which communicates with cavity 23 and in which is housed a spring 30 to assist in the closing of ducts 26 by ball check valve 24.

A large clearance, on the order of 2 mm measured on the diameter, and more generally between 1 and 2.5 mm is allowed between ring bearing 21 and rod 14.

Piston 10 lacks seals, which are standard in known pumps, the surfaces of said piston 10 in contact with the inside of pump body 2 being smooth and coated with a material suited to frictionless sliding, of the Teflon or nylon type.

Passages 16 and 17 through partitions 5 and 6, and also ducts 26 and 28, have large dimensions compared with those of passages ordinarily made in pumps of this type; thus the diameter of each of ducts 26 or 28 is at least on the order of 10 mm and preferably at least 20 mm, and in the particular embodiment described four ducts 26 and four ducts 28 are provided, with the result that the preferred section for passage of material at each level is at least 300 $mm^2$ and preferably at least 1200 $mm^2$.

The passage left free for the material on the inside of cavity 23, around ball 24 is such that its sectional area is no less than that of the passage consisting of the totality of either ducts 26 or 28.

According to a first embodiment shown in FIG. 1, the vane 15 is a simple plate.

Figure 2:
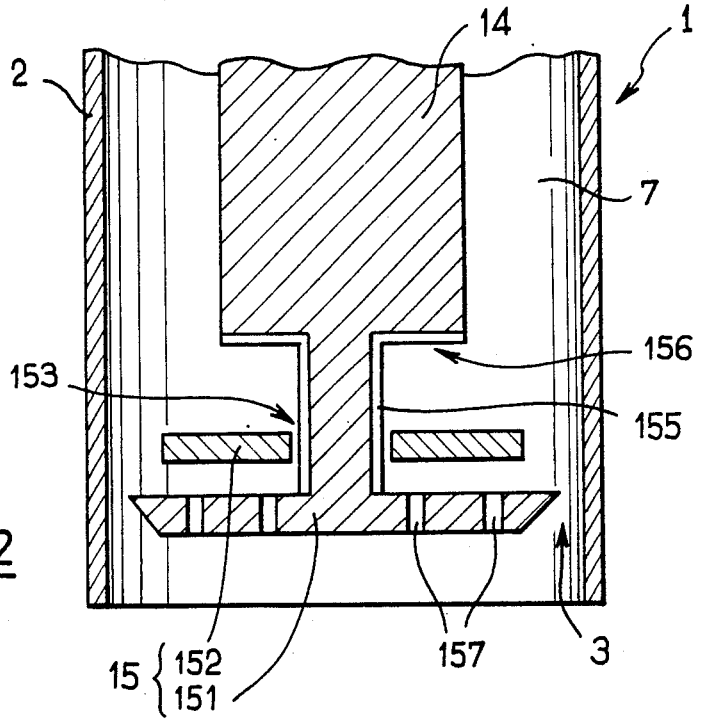
FIG. 2 is a detail view of a vane according to an embodiment of the invention.

According to a second embodiment shown in FIG. 2, this plate is improved to obtain better performance for pump 1.

This improved vane 15 comprises at least two parts: a disk 151 fastened to the extreme end of rod 14 and a plate 152 surmounting disk 151, extending parallel to said disk 151, and mounted so as to be able to slide on rod 14. To do this, the plate 152 is perforated in its center with a perforation 153 and slipped on the end of rod 14 before disk 151 is fastened. Advantageously, the end of rod 14 has a final portion or distal end whose section is slightly less than that of the rest of rod 14 and which is covered with a jacket 155 along which can slide plate 152. Shoulders 156 at the junction between this narrowed portion and the disk 151 constitute stops which limit the sliding of plate 152.

Advantageously, the clearance between jacket 155 and plate 152 is great and on the same order of magnitude as the one provided between bearing 21 and rod 14.

Plate 152 advantageously does not have dimensions greater than disk 151.

Disk 151 is pierced with through ports 157 for the passage of the material to be pumped. These ports 157 have a size on the same order as that of passages 16 and 17 and ducts 26 and 28.

The size of plate 152 and the position of ports 157 are such that all these ports 157 can be blocked by plate 152 when it is applied against disk 151.

Preferably, to facilitate the movement of vane 15 through the material to be pumped, its edges and in particular those of disk 151 are beveled.

Figure 3A:
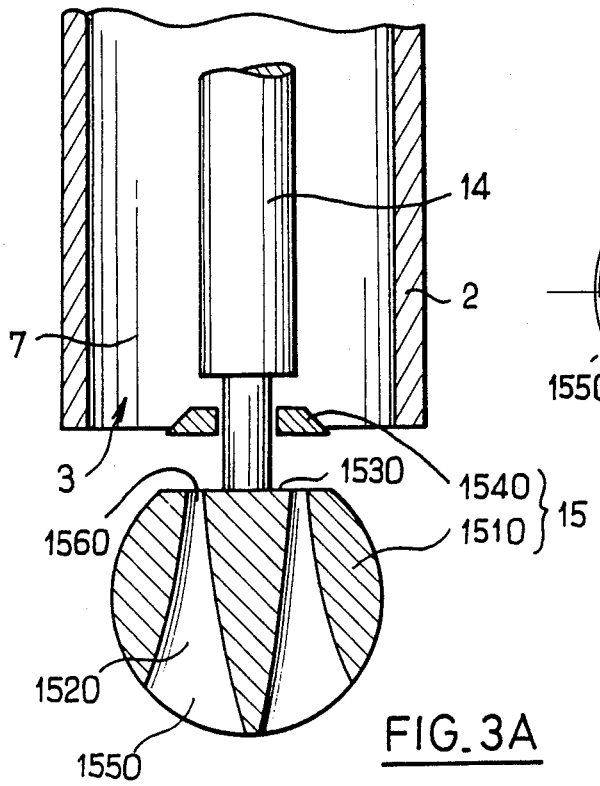
FIG. 3A is a detail view of a vane according to another embodiment of the invention.

According to a third embodiment shown in FIG. 3 (3A and 3B), the vane 15 is still further improved to obtain better performance of pump 1. The vane 15 in this embodiment consists essentially of a volume 1510 whose shape is "polyhydrodynamic," i.e., hydrodynamic in all directions. As an example of a "polyhydrodynamic" shape, a spherical or approximately spherical shape can be cited.

Advantageously, this volume 1510 is pierced with at least one through hole 1520 directed approximately in the direction of the length of the rod 14, i.e., in the direction of the movement of said volume during the reciprocating operation of the pump. This volume 1510 is then truncated; it is cut to remove a part spherical or approximately part spherical cap at the level of its junction with rod 14, thus providing a circular surface 1530, into which holes 1520, perpendicular to rod 14, come out. A plate 1540 extends parallel to surface 1530, and is mounted to slide along rod 14 so as to be able to move away from volume 1510 and to free holes 1520 or to be applied against circular surface 1530 and thus block holes 1520.

Figure 3B:
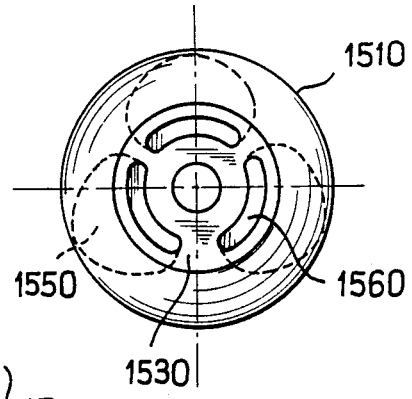
FIG. 3B is a top view of the vane of FIG. 3A.

Preferably, this plate 1540 is approximately of the same size as circular surface 1530, so as to be able to block holes 1520, and also so as not to constitute an obstacle to the advance of the material. Advantageously, to facilitate further the advance of the material, the edges of this plate 1540 are beveled. Each hole 1520 preferably has a venturi shape, i.e., it has a wide opening 1550 on the side opposite plate 1540 and a narrow outlet 1560 on the side of plate 1540. The number of holes 1520 is variable; one, two, three or more holes 1520 can exist. FIG. 3B shows a top view of the polyhydrodynamic volume. A possible distribution of outlets 1560 of three holes 1520 in circular surface 1530 appears in this figure. Intakes 1550 of these holes 1520 are represented by broken lines. Other distributions and arrangements are also possible. The edges which delimit holes 1520, on the side opposite plate 1540, are sharp and cutting, facilitating the role of hollow punch for volume 1510 and its penetration into the material to be pumped during the descent of the vane into said material.

Regardless of the embodiment used for vane 15, the section of rod 14 is less than that of shaft 11 so that the volume of the evacuation stage 9 when piston 10 is in the extreme low position is less than when piston 10 is in the extreme high position, thus making possible the double action operation of the pump.

The pump operates in the manner described below.

Piston 10 is pushed downward by the motor (not shown) through evacuation stage 9, thus pushing down rod 14 and attached vane 15. The bottom end of rod 14 and vane 15 then exit from pump body 2 and are immersed into the material to be pumped, stored in a tank not shown in FIG. 1. Vane 15 is thus charged with material to be pumped. During the descent of piston 10, the material filling buffer stage 8 and lower chamber 12 of evacuation stage 9 has a tendency to be compressed and driven downward, i.e., toward intake 3. This delivery toward the intake, as well as spring 22, cause ring valve 18 to move so as to close passages 16. The pressure of the material in lower chamber 12 lifts ball 24 and causes the material to pass into cavity 23, then through ducts 28 to upper chamber 13. Considering that the section of rod 14 is smaller than that of shaft 11, the amount of material stored in lower chamber 12 when the piston is in the high position is greater than what upper chamber 13 can contain and consequently the material is evacuated through outlet 4.

When the movement of piston 10 is reversed, vane 15 loaded with material rises in body 2 of the pump. The material thus carried by vane 15 exerts a pressure which causes ring-shaped check valve 18 to rise, thus making it possible for the material to penetrate into buffer stage 8 and then into lower chamber 12 of evacuation stage 9. During the lifting of the piston, the material in upper chamber 13 of evacuation stage 9 is expelled to outlet 4; ball check valve 24, acting in response to the weight of the ball, the assistance of spring 30 and the counterpressure, closes ducts 26 and prevents the delivery of material downward from chamber 13 into lower chamber 12.

Therefore, the material exits through outlet 4 during both phases of movement of the piston.

Thanks to the wide dimensioning of ducts 26, 28 and passages 16, the material can advance despite its thick consistency. Considering the ease with which it is allowed to pass through these ducts and passages, pressures remain low and leakage is avoided particularly between the piston and the inside wall of pump body 2.

Due to the high viscosity of the material, the resistance to movement of rod 14 and vane 15 is high and said rod deforms laterally under the force of compression regardless of its strength and its section. Thanks to the large clearance allowed between rod 14 and ring 21, no blocking is to be feared despite this buckling of rod 14.

The absence of attached seals at any place whatsoever prevents them from being loosened. The fluid-tightness without these seals will certainly be reduced but the thick consistency material itself fills up the interstices, prevents leaks and makes possible an unsealed operation.

Due to the weight of ball 24 and especially to the action of its associated spring 30 and to the counterpressure, said ball 24 is not likely to be prevented from redescending to close ducts 26 (to float in cavity 23) because of the thick material which surrounds it.

To the extent that vane 15 has been modified as shown in FIG. 2, the general operation remains identical. However, on the descent of rod 14 while the modified vane sinks into the material to be pumped, this material becomes engaged in ports 157, passes through them and pushes back plate 152 to cause it to separate from disk 151 and slide along the narrowed portion of rod 14 until it stops against shoulders 156. This material to be pumped which penetrates into the body of pump 1 through ports 157 is therefore added to the material which covers vane 15 when it is immersed and then rises. On the other hand, the material that covers vane 15 is the sole entrant into the pump when no through parts are provided.

The sinking of the vane into the material is facilitated by the beveled shape of the edges of disk 151.

When rod 14 reverses its movement and therefore rises inside the pump body, plate 152 performs the function of check valve.

The material above the vane and within the pump body is compressed by the rising vane, pushes back plate 152, and causes it to slide along the narrowed portion of rod 14 until it is applied against disk 151, thus blocking its ports 157.

To the extent that vane 15 has been modified as shown in FIG. 3, the general operation remains identical. However, in addition, thanks to its hydrodynamic shape, vane 15 is immersed more easily into the material to be pumped. This ease of immersion is further increased by the hollow punch role of the "polyhydrodynamic" volume 1510 through which holes pass whose edges are sharp and cutting. During the immersion, the cutting edges slice a plug of material which is engaged in each hole 1520. The material so pressed in each hole 1520 exits with a great pressure through each outlet 1560 and causes plate 1540 to rise.

The particular shape of volume 1510 causes the material to creep and advance along its wall and be directed into the space located above vane 15 and this material driven by the vane 15 creeps more easily along the wall of the volume to penetrate into boosting or intake stage 7 of pump 1 as the hydrodynamic properties of the shape of the vane 15 increase. Furthermore, this "polyhydrodynamic" shape facilitates the advance of the material to be pumped toward the center of the space located above vane 15, which is beneficial for the good operation of the pump and for increasing its flow efficiency.

Actually, the material delivered above vane 15 is more easily lifted by said vane into boosting or intake stage 7, than if it were, on the contrary, instead driven toward the walls of the tank containing the material.

During the upward movement of vane 15, plate 1540 is applied against holes 1520, thus obstructing them. All the material which has passed through the holes 1520 or which has crept along profile 1510, and which therefore is above vane 15, then enters into boosting stage 7 of the pump, because of the rise of said vane into the pump body.

Moreover, during the rising of vane 15 under the action of the motor of the pump, it seems that the "polyhydrodynamic" shape produces a suction effect on the material to be pumped, an effect which prevents the creation under vane 15 of a cavity void of material. This is also beneficial for the good operation of the pump and for increasing its flow efficiency, since, at the beginning of the following cycle, when the vane will again descend into the tank containing the material to be pumped, it will immediately encounter material.

Advantageously, this pump 1 is coupled with a conically shaped heating plate; such a plate being described in the French Patent Applications published under Nos. 2 567 448 and 2 570 322. This plate associated with pump 1 according to the invention is shown mounted on a tank containing material to be pumped in FIG. 4.

The plate carries the reference 31, the tank the reference 32. The conically shaped plate 31 is therefore mounted on tank 32 with its conically lower surface turned toward the interior of said tank 32. The inclination of the walls of the conical plate is on the order of 45°. The plate 31 is equipped with heating appendages 33 directed approximately along the conically shaped axis, on the inside of tank 32. It is pierced at the apex of the cone with an opening 34 in which the intake end of pump 1 is mounted. Fluid-tightness means, shown in FIG. 5 and detailed later, are placed between the pump body and opening 34 of plate 31. Fastening means, also shown in FIG. 5 and detailed later, fix pump 1 and plate 31 with one another. This plate 31 is pressed with force against the material of tank 32, via jacks such as 35 placed between a base 36 which carries tank 32 and a gantry 37, the latter connected to plate 31 by means of bars 38.

Figure 4:
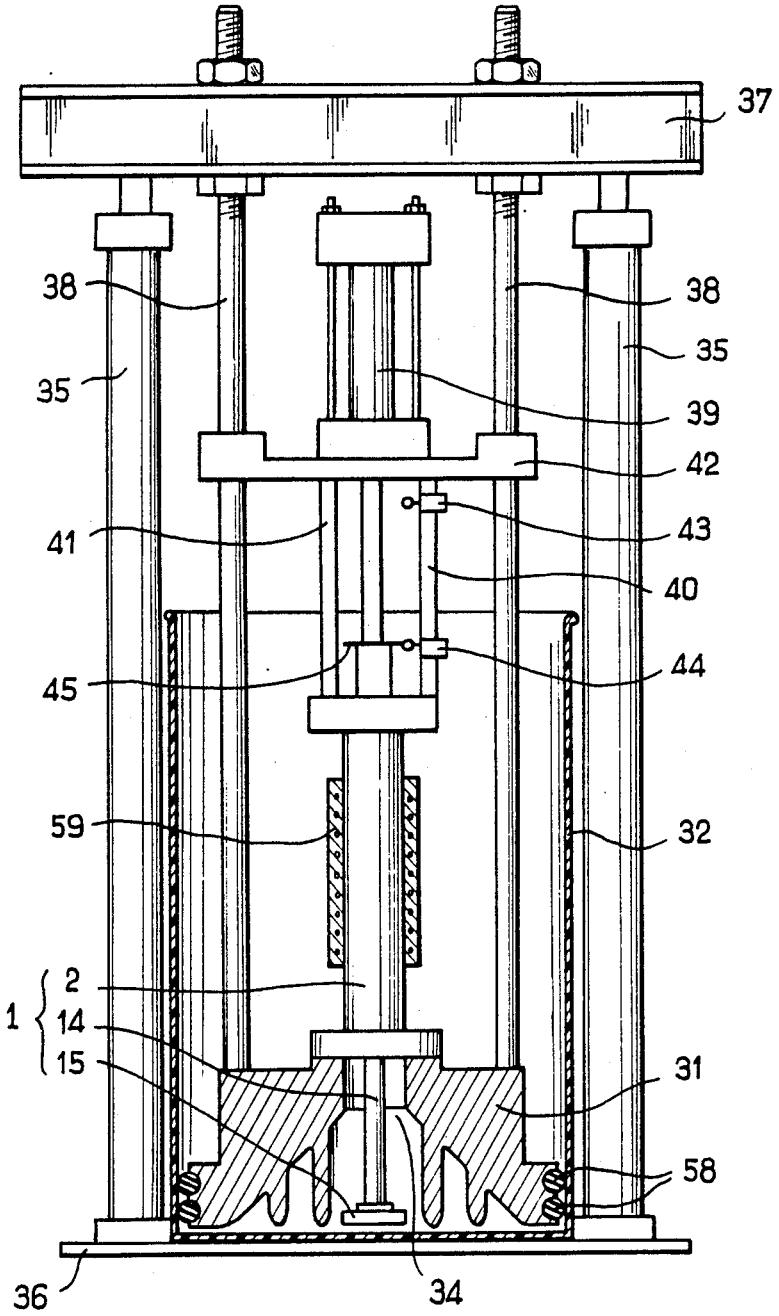
FIG. 4 is an elevational view of a pumping unit having a pump according to the invention associated with a conical heating plate.

FIG. 4 shows hydraulic motor 39 acting on piston 10 of pump 1. This motor 39 is carried by two supports 40 and 41 resting on pump 1 itself. To rigidify and to better stiffen the pump/heating plate unit, this motor 39 rests at the same time on a crosspiece 42 connecting the two bars 38.

One of supports 40, 41, for example 40, further carries two switches 43, 44—one above the other—actuated on the passage of a plate 45 belonging to shaft 11 connecting motor 39 to piston 10. These switches 43, 44 have the function of controlling the reversals of direction of motor 39.

Figure 5:
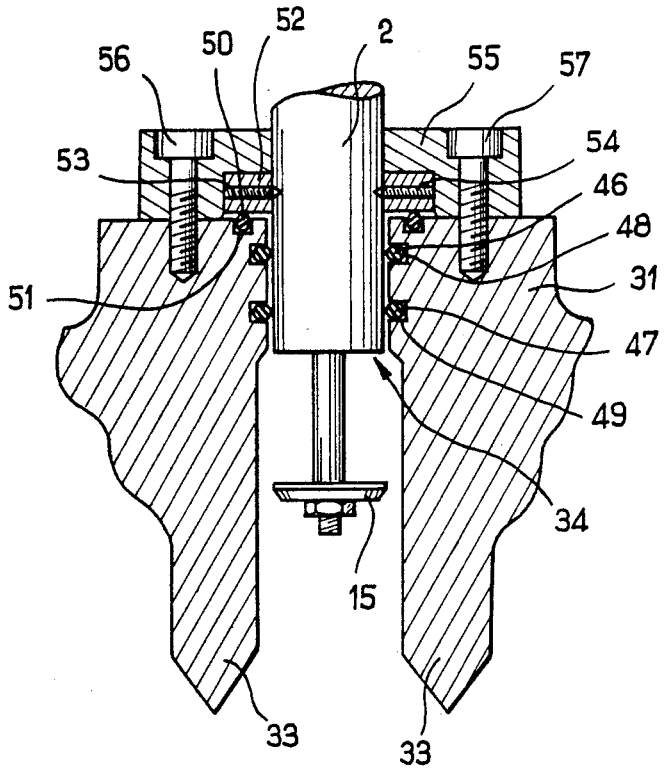
FIG. 5 is a detail of the unit of FIG. 4 showing more particularly the junction of the pump and the conical heating plate and the means assuring the fluid-tightness at the junction.

FIG. 5 shows in detail the fluid-tightness means between pump body 2 and conical heating plate 31 as well as the means for fastening one to another. It constitutes an enlargement of FIG. 4 at the junction between conical heating plate 31 and the low part of pump body 2. Of conical heating plate 31, there are seen only two heating appendages 33 and opening 34 at its vertex in which pump body 2 is engaged.

The fluid-tightness between the pump body 2 and the conical heating plate 31 is obtained by a multiplicity of levels of O-rings. According to FIG. 5 two O-rings 46 and 47 engaged in grooves 48 and 49 of the vertical wall of opening 34 bear on pump body 2, and an additional O-ring 50 is engaged in a groove 51 on the vertex of plate 31, this additional seal 50 being compressed between the top of conical plate 31 and a ring 52 which, in a completely adjustable way, surrounds pump body 2.

This ring 52 is fastened on the pump body by set screws 53, 54 and it is further flange-mounted with a counter-ring 55 fastened by screws 56, 57 to conical plate 31.

Furthermore, seals 58 shown in FIG. 4 are also provided on the periphery of conical heating plate 31 to achieve fluid-tightness between said plate 31 and tank 32. These seals are described in greater in French Patent Application No. 84-14184.

To facilitate the restarting of pumping after a stop time during which the material contained in pump 1 has cooled and hardened, a thermostat controlled heating belt 59 (see FIGS. 1 and 4) is provided around pump body 2. This belt 59 is formed, for example, of a good heat-conducting metal such as aluminum and provided with electric resistors.

The pumping unit operates as follows: Heating plate 31 surmounted by the reciprocating vane pump is mounted on the tank of material to be pumped and is pressed by jacks 35 against the material to be pumped. The pressing and the heating of the plate cause to be present in the conically shaped volume of plate 31 a material that is somewhat softened and somewhat heated, all the more softened and heated the closer it is to the outlet port 34 at the apex of cone. Thanks to the inclination of the walls of the plate, this material has a tendency to converge toward the apex of the cone. The vane of the vane pump there descends to be charged with material.

As a result viscous material contained in the tank can be pumped. A material having a Mooney viscosity of at least 115° at the end of 8 minutes and at 40° C., a measurement made with a Mooney consistometer, stored in the tank at ambient temperature, can be pumped with a flow rate on the order of 1.5, 2 and even more than 2 kg per minute, at a relatively low temperature, lower than 100° C., (95° C. and 90° C. respectively in the case of FIGS. 2 and 3 vanes) and under a relatively low pressure which can be less than 200 bars at the output of pump 1.

Of course, if desired, this temperature can be increased by more heating, and the pressure can be increased by acting on the hydraulic motor of the pump. But generally, for a given flow as low a pressure and temperature as possible are sought.

In the production of a sized bead for a seal and interlayer of multiple glazings, from a material having the Mooney consistency indicated above, the pumping unit previously described is completely recommended. For different materials, the performances will be slightly different. Thus, there are materials, other than the material having a butyl rubber and/or polyisobutylene base with a Mooney viscosity greater than 115°, for which known pumps already provide a non-zero flow. The use of the unit according to the invention makes it possible to increase the provided flows, and/or to lower the temperature of the material provided, and/or to reduce the pressure under which the material is provided.

Improved flow makes it possible to envisage the continuous production of larger glazings or glazings with thicker interlayer seals, and/or at a greater speed of advance of the sheets of glass under an extrusion head providing the sized bead of the material pumped with the unit according to the invention.

In all applications, the fact of having a large flow of material under a relatively low temperature and pressure allows the use of equipment downstream that is less high-powered, and therefore less costly and less specialized.

Obviously, numerous modification and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A reciprocating vane pump for thick materials having a viscosity greater than 35,000 poises, comprising:

a pump body having a material inlet and a material outlet;

a piston slidably positioned in said pump body;

a rod fixed to said piston and extending therefrom along the length of said pump body to said material inlet;

a vane fixed to a distal end of said rod at said material inlet;

at least two partitions spaced along the length of said pump body to separate the interior of said pump body into a plurality of stages, said partitions having ports for permitting passage of said rod, said ports each having a clearance with respect to said rod large enough to permit free passage of the material therepast; and check valves associated with at least one of said ports and with said piston for permitting material flow only from said inlet to said outlet, said check valves each providing a clearance, when open, sufficient to permit free passage of the material therepast, whereby material is pumped from said inlet to said outlet by reciprocation of said piston in said pump body, wherein said check valve associated with said at least one port comprises a ring shaped valve member surrounding said rod with a diametrical clearance of between 1 and 2.5 mm and having a bronze bearing surface for guiding said rod.

2. The reciprocating vane pump according to claim 1, including spring means for biasing each said check valve into a closed position.

3. The reciprocating vane pump according to claim 1, wherein said piston has smooth walls, and lacks attached seals.

4. The reciprocating vane pump according to claim 1, including a heating belt surrounding said pump body.

5. The reciprocating vane pump according to claim 1, wherein each said port has a diameter of at least 10 mm.

6. The reciprocating vane pump according to claim 5, wherein each said port has a diameter of at least 20 mm.

7. The reciprocating vane pump according to claim 6, wherein said partition and check valve clearances each have a section area of at least 1200 $mm^2$.

8. The reciprocating pump according to claim 1, wherein said vane comprises at least two superposed parts including:

a disk pierced with material passage ports and fixed to said distal end of said rod; and a plate extending parallel to said disk and slidably mounted on said rod so as to be able to alternately press against and move away from the disk.

9. The reciprocating vane pump according to claim 8, wherein edges of said disk are beveled to facilitate immersion of said disk into material to be pumped.

10. The reciprocating vane pump according to claim 8, wherein said distal end of said rod along which said plate can slide is of reduced sectional area compared with a remainder of said rod, and is covered with a jacket.

11. The reciprocating vane pump according to claim 8, wherein said plate has dimensions no greater than those of said disk.

12. The reciprocating vane pump according to claim 8, wherein said plate has sufficient dimensions to cover all of said material passage ports of said disk.

13. The reciprocating vane pump according to claim 1, wherein said vane comprises a volume whose shape is hydrodynamic in all directions.

14. The reciprocating vane pump according to claim 13, wherein said hydrodynamically-shaped volume is at least approximately spherical.

15. The reciprocating vane pump according to claim 13, wherein said volume is truncated at a junction with said rod, includes at least one through hole extending in the direction of said rod and is surmounted by a plate slidably mounted on said rod for reciprocation towards and away from said volume.

16. The reciprocating vane pump according to claim 15, wherein each said through hole has a venturi shape.

17. The reciprocating vane pump according to claim 15, wherein edges of each said through hole on a side thereof opposite said plate are sharp.

18. The reciprocating vane pump according claim 15, wherein said plate has approximately the same size as the truncated surface of said volume so as to permit the obstruction of said through holes, and so as not to disturb the flow of material along the surface of said volume.

19. The reciprocating vane pump according to claim 1, including a hydraulic motor for driving said piston for reciprocation.

20. The reciprocating vane pump according to claim 19 including a shaft connecting said piston with said motor, wherein a portion of said shaft within said pump body has a sectional area greater than that of said rod, whereby material is pumped during both directions of reciprocation of said piston.

21. The reciprocating vane pump according to claim 19 in combination with a pumping unit comprising:

a tank for storing the material;

a conically shaped plate having a conically shaped concave lower surface, a through hole at the apex of said conically shaped lower surface, and heating appendages;

means for movably supporting said conically shaped plate such that said lower surface presses against said material; and means for supporting said reciprocating vane pump such that said vane extends through said through hole in said conically shaped plate and into said material during reciprocation of said piston, whereby material from said tank is pumped by said pump.

22. The reciprocating pump according to claim 21, including means for fluid tightly fixing said pump body to said conically shaped plate.

23. The reciprocating vane pump according to claim 22, wherein said clearances of said ports and said check valve are sufficient to permit free passage of thick materials having viscosities of at least 115° Mooney at the end of a test of 8 minutes at 40° C., said materials comprising mastics having a base taken from the group consisting of butyl rubber and polyisobutylene, and a molecular weight of 8,000 to 15,000.

* * * * *

UNITED STATES PATENT AND TRADEMARK OFFICE

CERTIFICATE OF CORRECTION

PATENT NO. : 4,875,833

DATED : Oct. 24, 1989

INVENTOR(S) : Michel Canaud, et al

It is certified that error appears in the above-identified patent and that said Letters Patent is hereby corrected as shown below:

Title page:

The first Priority Data is incorrectly recorded,
"Feb. 20, 1986 [FR] France.....86 02344", should be:

--Feb. 20, 1986 [FR] France.....86 02343--

Signed and Sealed this

Thirtieth Day of October, 1990

*Attest:*

HARRY F. MANBECK, JR.

*Attesting Officer*

*Commissioner of Patents and Trademarks*